United States Patent [19]

Suligoy et al.

[11] 4,271,731

[45] Jun. 9, 1981

[54] PIVOT TIP HAND TOOL

[76] Inventors: Diane Suligoy, R.R. 5, Mound Rd., Joliet, Ill. 60436; Sharon Cook, 9704 Stacy, Union, Ill. 60180

[21] Appl. No.: 73,159

[22] Filed: Sep. 7, 1979

[51] Int. Cl.[3] ..... B25G 1/00; B25B 13/00

[52] U.S. Cl. ..... 81/177 ST; 81/177.8

[58] Field of Search ..... 81/177 A, 177 ST, 177 PP, 81/177 UJ, 177.8, 177.9; 145/50 A, 50 C, 61 G, 61 L

[56] References Cited

U.S. PATENT DOCUMENTS

| | | | |
|---|---|---|---|
| 750,182 | 1/1904 | Furbish | 145/50 C X |
| 1,269,413 | 6/1918 | Finnigan | 81/177 A X |
| 1,616,300 | 2/1927 | Bido | 145/50 C |
| 2,794,357 | 6/1957 | Lykins, Jr. | 81/177 UJ |

*Primary Examiner*—James G. Smith

*Attorney, Agent, or Firm*—Ernest S. Kettelson

[57] ABSTRACT

A pivot tip hand tool comprising an elongated shank, an axial recess or bore therein opening to the work piece end, a work-piece shaft positioned in said bore for relative sliding movement between a retracted position and an extended position, a first lock assembly to hold said shaft in the extended position until released, a socket member pivotally mounted on the work-piece shaft having a socket for receiving the shank of a tool such as a screwdriver therein, the socket member being pivotable between a first position in which its socket is axially aligned with the work piece shaft and a second position in which its socket is at a substantially right angle to said shaft, and a second lock assembly to hold said socket member in said first and second positions, respectively, until released.

2 Claims, 15 Drawing Figures

PIVOT TIP HAND TOOL

BACKGROUND OF THE INVENTION

The invention relates to the field of hand tools having a pivot or swivel tip work piece.

Other devices of this kind known to the prior art included a distributor adjustment tool having a pivotal hexagonal headed tool bar as described in U.S. Pat. No. 4,028,968; a screw driver whose handle may be adjusted angularly to different positions as set forth in U.S. Pat. No. 3,773,094; a multiple tool bit work piece which may be rotated 180 degrees to position four different work pieces in axial alignment with the shank of the tool as disclosed in U.S. Pat. Nos. 3,014,388 and 2,933,963; and a ratchet tool having an angularly adjustable handle as disclosed in U.S. Pat. No. 2,656,865. Another prior art device of some relevance to the invention which is the subject of this application is described in U.S. Pat. No. 3,351,111, disclosing a tool having holding means in which a portion extends into the bore of the shank.

One of the problems with prior art devices of this kind is maintaining rigidity of the pivotal work piece end, while at the same time enabling quick and easy movement of the pivot tip work piece end from one working position to another. The present invention solves such problems by use of a work piece shaft slidably received in the bore of the hand tool's shank which can be easily locked and released in both an extended and retracted position, and a pivotable work piece pivotally mounted on the end of the work piece shaft which can be easily locked and released in both an axially aligned position and one at right angles to the work piece shaft.

SUMMARY OF THE INVENTION

It is an object of the invention to provide a pivot tip hand tool having a work piece pivotally mounted at one end which may be rigidly held in a plurality of different working positions and which may be easily released from one working position and pivotally moved to another.

It is an object of the invention to provide a pivot tip hand tool, having an elongated shank, an axial bore in said shank opening to the work piece end, a work piece shaft slidably positioned in said axial bore between a retracted and an extended position, first lock means to hold said shaft in at least the extended position, a work piece end member pivotally mounted at one end of said work piece shaft, and second lock means to lock said work piece end in a plurality of different working positions.

It is an object of the invention to provide a pivot tip hand tool, having an elongated member connected to a hand grasp member, an axial bore in said elongated member opening to a work piece end, a work piece shaft connected to said hand grasp member and extending from said work piece end of said elongated member, said elongated member and said work piece shaft being in sliding relationship between a retracted and extended position, first holding means to hold in said extended position, a work piece end member pivotally mounted on said work piece shaft, and second holding means to hold said work piece end in a plurality of different working positions.

DESCRIPTION OF PREFERRED EMBODIMENT

Figure 1:
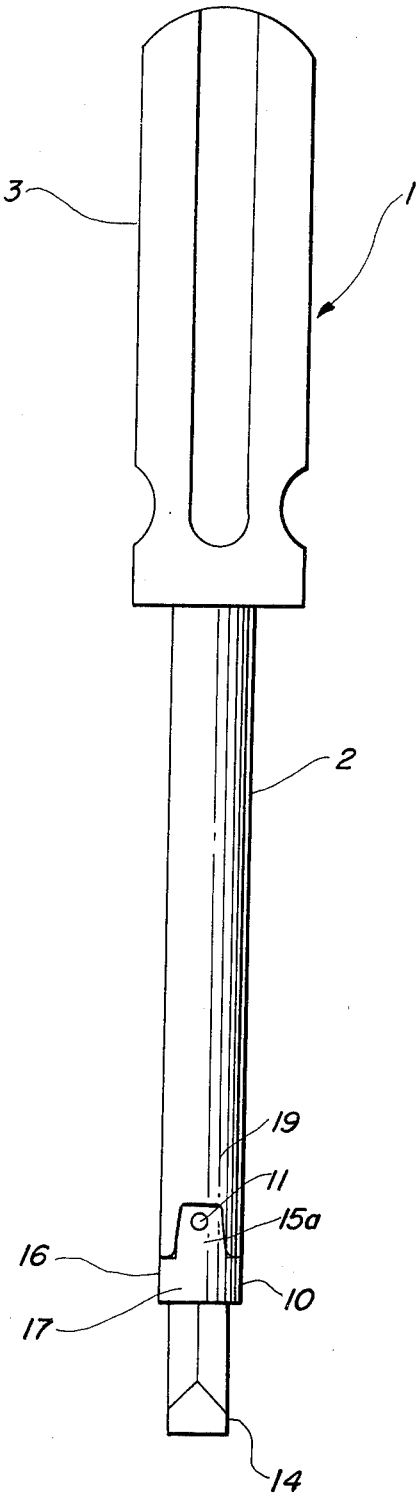
FIG. 1 is an elevation view of a hand tool in accordance with this invention, showing the pivot tip work piece in the position of axial alignment with the shank of the tool.

A hand tool 1 in accordance with this invention includes an elongated shank 2 extending from the handle 3, in which an elongated axial bore or recess 4 is provided having a polygonal cross-section and bounded by a hexagonal inner wall 5. The recess 4 opens to the work-piece end 6 of the elongated shank 2.

Figure 2:
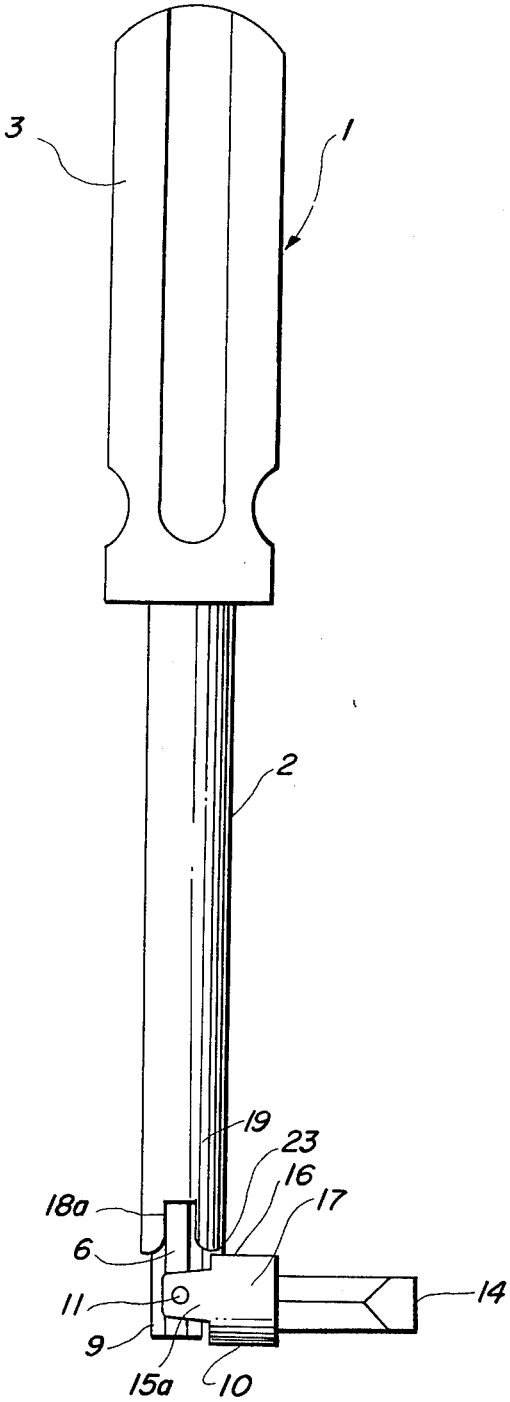
FIG. 2 is an elevation view of the hand tool of FIG. 1, showing the pivot tip work piece in the position which is at a right angle to the shank of the tool.
Figure 3:
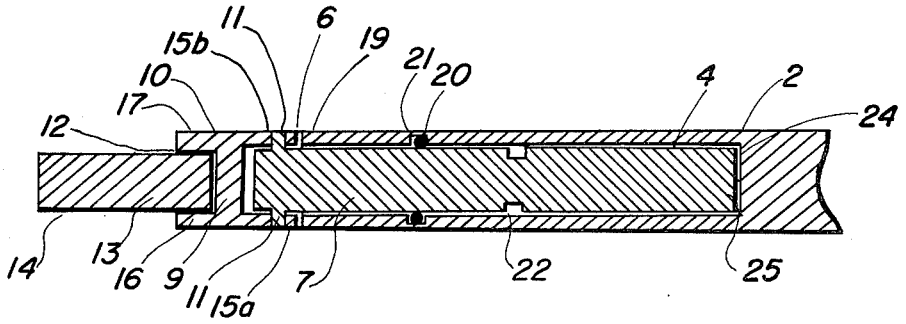
FIG. 3 is a section taken on line 3—3 of FIG. 1.
Figure 4:
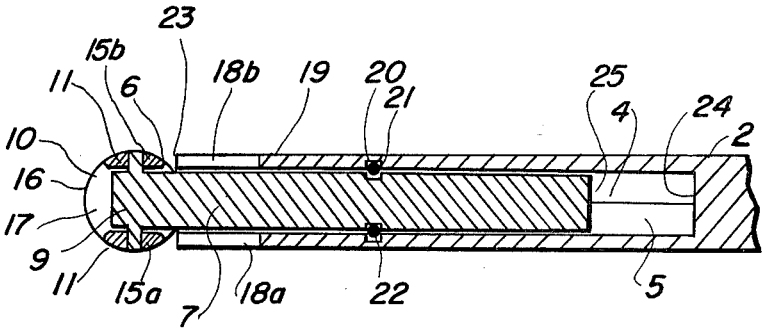
FIG. 4 is a section taken on line 4—4 of FIG. 2.
Figure 5:
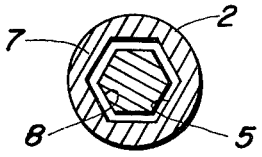
FIG. 5 is a section taken on line 5—5 of FIG. 4.
Figure 6:
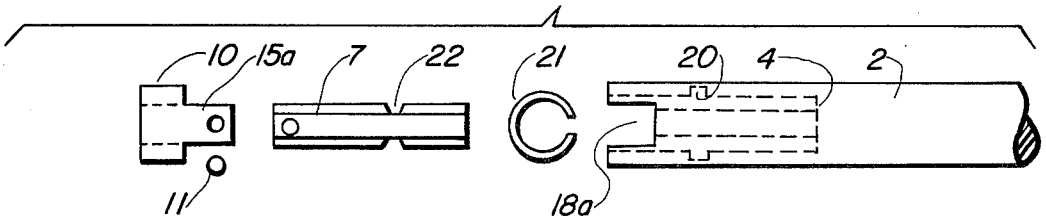
FIG. 6 is an exploded view of the work piece end of the hand tool of FIG. 1.

A work-piece shaft 7, having a polygonal cross-section corresponding to that of the recess 4 and including a hexagonal peripheral wall surface 8, is slidingly positioned in recess 4 for reciprocal movement between a retracted position (as shown in FIGS. 1 and 3) and an extended position (as shown in FIGS. 2 and 4). A projecting end portion 9 of the work-piece shaft 7 extends outwardly of recess 4 when in the extended position.

A socket member 10 is pivotally attached to the projecting end portion 9 of shaft 7 by means of pivot pins 11. The socket member 10 includes a socket cavity 12 having a conventional polygonal or ribbed cross-section to receive the correspondingly cross-sectioned shank end 13 of a tool 14 such as the screw driver tip shown in the drawing.

The socket member 10 includes a pair of ears **15*a* and 15*b* which extend longitudinally from opposite sides of the wall 16 of the body portion 17 of the socket member 10. The pivot pins 11 are seated in the ears 15 at one end, and anchored to the projecting end portion 9 of the slidable shaft 7 at their other end, to pivotally mount the socket member 10 on the end portion 9 of shaft 7**.

A pair of notches or grooves **18*a* and 18*b* are provided in the wall 19 of the elongated shank 2 at the work-piece end portion 6, shaped and dimensioned to snugly receive ears 15*a* and 15*b* respectively therein when socket member 10 is pivoted to the axially aligned position with respect to work-piece shaft 7 and said shaft 7 is in the retracted position. The grooves 18***a* and 18*b* lock the socket member 10 in such axially aligned position when the ears 15*a* and 15*b* are seated therein.

An annular recess or groove 20 is provided around the inner wall 5 of the bore 4 of the elongated shank 2, at an intermediate location, said groove 20 opening to the recess or bore 4. A snap ring 21, comprising a C-shape spring metal member and being compressible and expandable, is seated in the annular recess or groove 20.

A locking groove 22 is formed around the periphery of the work piece shaft 7 at a location thereon which is in registration with annular groove 20 around inner wall 5 of the bore 4 of elongated shank 2 when said work piece shaft 7 is in its extended position. When said grooves 20 and 22 are in registration with each other, the snap ring 21 snaps into locking groove 22 far enough to hold the shaft 7 in its extended position, a portion of snap ring 21 remaining seated in annular groove 20.

When shaft 7 is in its extended position, the ears 15*a* and 15*b* are out of the grooves 18*a* and 18*b*, thereby permitting the socket member 10 to be pivoted on pivot pins 11 from a first work position in axial alignment with the elongated shank 2 and work piece shaft 7, to a second work position in which the longitudinal axis of the socket member 10 is normal to the longitudinal axes of the elongated shaft 2 and the work piece shaft 7 mounted coaxially with elongated shaft 2 in the axial bore 4.

The socket member 10, work piece shaft 7 and elongated shaft 2 are preferably of ferrous metal, with one or more magnetized at the region of the work piece end 6. Thus, when socket member 10 is pivoted to the second work position at substantially a right angle to the elongated shaft 2, the magnetized end 6 of elongated shaft 2 will attract the ferrous metal of socket member 10 at the point 23 where it meets elongated shaft 2 to form the right angle, to magnetically hold the socket member 10 in the said second work position.

The work piece shaft 7 and socket member 10 both being held in position respectively by two separate locking or holding means, gives the pivotable socket member 10 in the second work position substantial rigidity and stability in that position which approaches that of a non-pivotable socket member which was rigidly affixed or integrally formed in that position. The two separate locking or holding means include (1) the snap ring 21 and locking groove 22 for the work-piece shaft 7, and (2) the magnetized portions of one or more of the elongated shank 2, the work-piece shaft 7, and the socket member 10 in the region of the work-piece end 6 and the area 23 adjacent the substantially ninety degree angle bounded by the elongated shaft and socket member 10, as the holding means for socket member 10 in the second work position.

Similarly in the first work position in which the axis of socket member 10 is axially aligned with the axes of elongated shank 2 and work piece shaft 7, there are also two separate locking or holding means to give the pivotable socket member 10 in this first work position substantial rigidity and stability approaching that which an integrally formed or rigidly affixed, non-pivotable, socket member would have. The two separate locking or holding means include (1) the ears 15*a* and 15*b* of socket member 10 received snugly within the notches or grooves 18*a* and 18*b* of elongated shank 2, as far as the socket member 10 is concerned, and (2) the abutting end wall 24 of the axial recess 4 in elongated shank 2 and the inwardly extending end 25 of work-piece shaft 7 which abuts against end wall 24 when shaft 7 is in its retracted position, as far as the work-piece shaft 7 is concerned.

Figure 7:
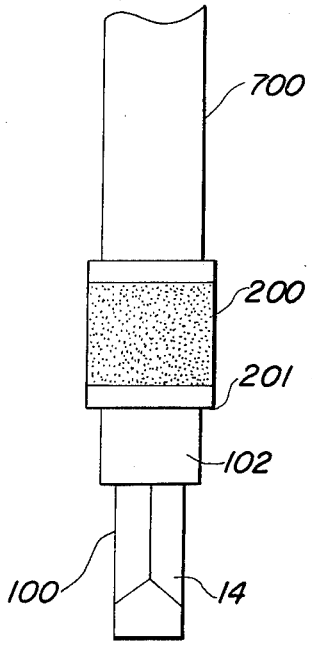
FIG. 7 is an elevation view of the working end portion of a modification of a hand tool in accordance with this invention, showing a retractable collar in its extended position.
Figure 8:
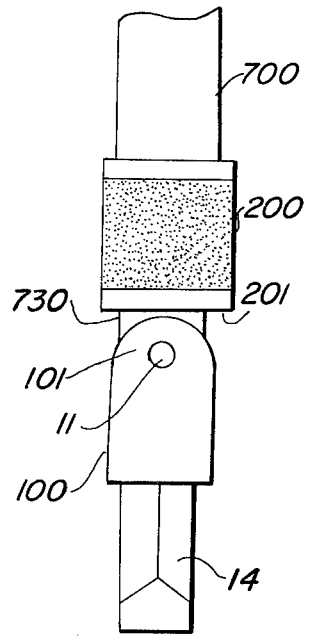
FIG. 8 is an elevation view of the device in FIG. 7, showing the retractable collar in its retracted position.
Figure 9:
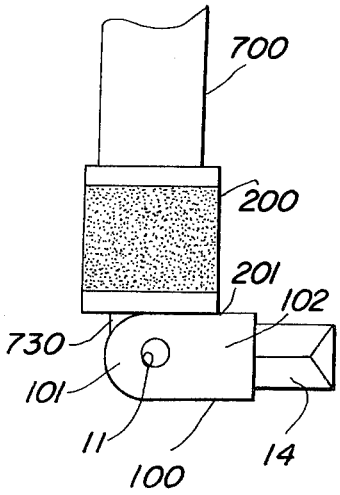
FIG. 9 is an elevation view of the device in FIG. 8, showing the pivot tip end at a right angle relative to the axis of the retractable collar.
Figure 10:
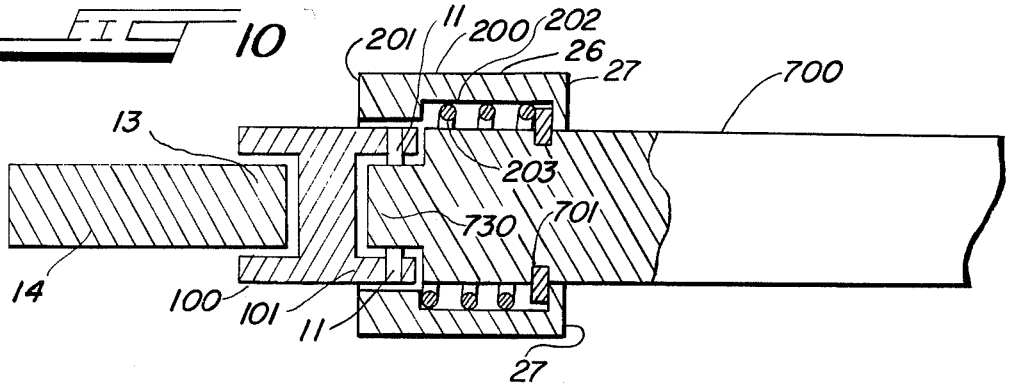
FIG. 10 is a section taken on line 10—10 of FIG. 7.
Figure 11:
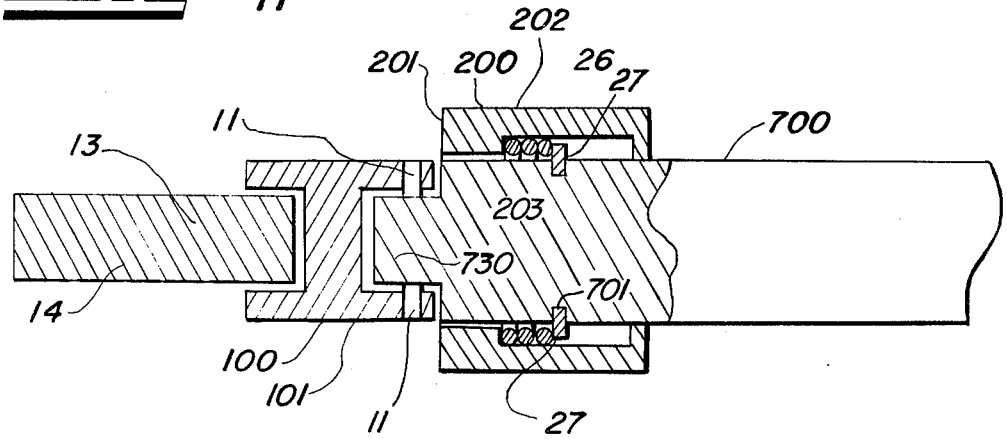
FIG. 11 is a section taken on line 11—11 of FIG. 8.

A modification of the invention is shown in FIGS. 7–11. Instead of a work-piece shaft 7 sliding in and out of a recess in the elongated shaft 2 of the hand tool to change positions of the pivot tip socket member 100, the work-piece shaft 700 of the modification is held stationary and an elongated collar 200 which surrounds the shaft 700 is moved back and forth between a retracted position (as shown in FIGS. 8 and 11) and an extended position (as shown in FIGS. 7 and 10).

In the extended position, the leading edge 201 of collar 200 snugly overlaps the pivotal end portion 101 of socket member 100 thereby holding socket member 100 in the first work position of axial alignment with the work piece shaft 7.

In the retracted position, the leading edge 201 of collar 200 clears the pivotal end portion 101 of socket member 100 thereby enabling socket member 100 to pivot on pivot pins 11 to the second work position in which the axis of socket member 100 is substantially normal to the longitudinal axis of the work piece shaft 7. FIG. 9 shows the work piece end of the modified hand tool of this invention in the second position.

A coil compression spring 26 is seated in an annular recess 202 of the elongated collar 200. One end of the spring 26 rests against annular ring 27, which is seated in annular groove 701 of the work piece shaft 700. The other end of the spring 26 rests against an annular ledge 203 at the end of the annular recess 202 nearest the work piece end 830 of the work piece shaft 700, whereby the elongated collar 200 is normally biased toward the work piece end 730 which is the extended position of collar 200.

When the socket member 100 is pivoted to the second work position as shown in FIG. 9, the leading edge 201 of collar 200 presses against the side wall 102 of socket member 100 under the bias of spring 26, to hold it in such second position.

To operate the pivot tip hand tool in accordance with this invention, starting with the first work position, the work piece shaft 7 is pushed inwardly until its inwardly facing end 25 abuts against the abutting end wall of axial recess 4 of the elongated shaft 2, and the ears 15*a* and 15*b* of socket member 10 are fully seated in the notches or grooves 18*a* and 18*b* respectively. A screw driver tip or other tool bit is seated in socket member 10, and the tool is ready for use in the first work position.

To change the socket member 10 to the second work position, the work piece shaft 7 is pulled outwardly until annular snap ring 21 seats in the annular locking groove 22 to hold work piece 7 in the extended position. The ears 15*a* and 15*b* of socket member 10 are at such time completely out of the grooves 18*a* and 18*b*, whereupon socket member 10 can be pivoted on pivot pins 11 to the second work position, in which its axis is substantially normal to the axes of the elongated shank 2 and work-piece shaft 7. The magnetized portions of one or more of the elongated shank 2, work piece shaft 7 and socket member 10 magnetically hold the socket member 10 in such second work position until it is desired to change back to the first work position.

To do so, requires only pivoting the socket member 10 back to the axial alignment position and pushing the work-piece shaft 7 into the retracted position. The screw driver tip 14 or other tool bit extending from the socket member 10 can be grasped and used as a lever to overcome the magnetic attraction force of the magnetized pieces if necessary to pivot the socket member 10 from the right angle position to the axially aligned position. The end of the tool bit, or of the socket member 10, can be tapped if necessary to break the snap ring 21 out of the locking groove 22 to enable pushing the shaft 7 back into its retracted position.

In the modification shown in FIGS. 7–11, starting with the first work position, the socket member 100 is placed in the position of axial alignment with shaft 700, and elongated collar 200 is allowed to move to its extended position under the bias of spring 26 where it overlaps the pivot end portion 101 of socket member 101 holding it in said first work position.

To change the socket member 100 to the second work position, the collar 200 is drawn back to the retracted position at which its leading edge 201 clears the pivot end portion 101 of socket member 100. The socket member 100 is then pivoted on pivot pins 11 to the second work position in which its axis is substantially normal to that of shaft 700. The collar 200 is then released, allowing its leading edge 201 to move into contact with and bear against the adjacent portion of side wall 102 of socket member 100 under the bias of spring 26 to hold the socket member 100 in the second work position.

When it is desired to return the socket member 100 to the first work position of axial alignment, the socket member 100 is pivoted back to such position, the leading edge 201 of collar 200 being pushed rearwardly slightly against the bias of spring 26 to permit the pivot end 101 of socket member 100 to rotate into the axially aligned position. The collar 200 is then allowed to move to its extended position under the bias of spring 26 where it overlaps the pivot end portion 101 of socket member 100 and holds it snugly in axial alignment in the first work position.

Figure 12:
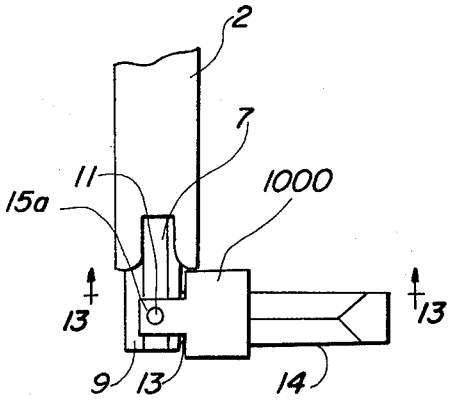
FIG. 12 is a side elevation of the pivot tip end of another modification of this invention shown pivoted to the right angle work position.
Figure 14:
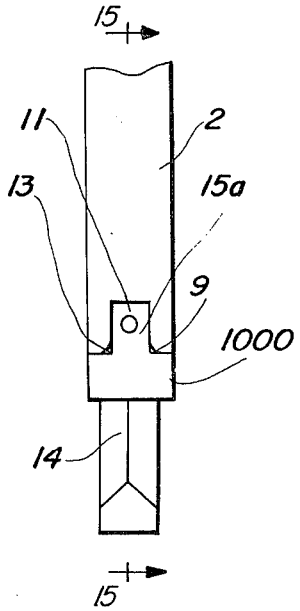
FIG. 14 is a side elevation of the pivot tip end of FIG. 12 shown in the axially aligned work position.
Figure 13:
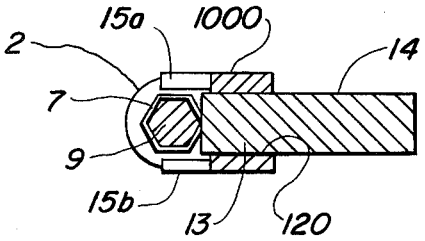
FIG. 13 is a section view taken on line 13—13 of FIG. 12.
Figure 15:
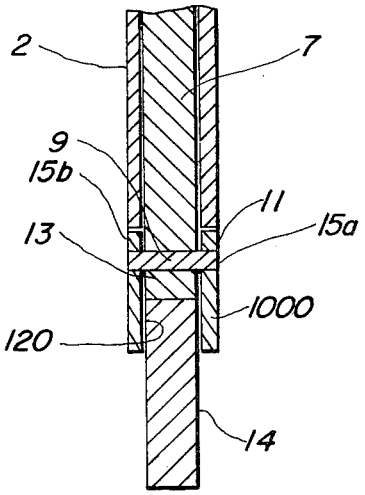
FIG. 15 is a section view taken on line 15—15 of FIG. 14.

In the form of the invention shown in FIG. 12, the socket member 1000 includes a hexagonal axial bore 120 which extends all the way through, instead of the socket cavity 12. The shank end 13 of the tool 14 is inserted into and all the way through the axial bore 120 whereby it abuts against the end 9 of shaft 7 when in the axially aligned first work position as shown in FIGS. 14 and 15.

When the socket member 1000 is pivoted to the second work position as shown in FIG. 12 in which the axis of the socket member 1000 is substantially normal to the longitudinal axis of the work piece shaft 7, the shank end 13 of tool 14 is pushed against a side wall portion of the end portion 9 of shaft 7. In this way, when tool 14 is applied to a work piece and pushed thereagainst the shank end 13 is forced more firmly against the wall end 9 of work piece shaft 7. Such pressure of the shank end 13 against the wall of shaft end portion 9 tends to hold this modification of socket member 1000 in the second work position. In fact, before the socket member 1000 can be pivoted back to the first axially aligned work position, the shank end 13 of the tool 14 has to be moved axially outward a sufficient distance to enable work piece shaft end 9 to clear.

We claim:

1. A pivot tip hand tool, comprising a hand grasp member, an elongated member aligned with said hand grasp member, a work piece shaft mounted in relation to said elongated member for relative movement therewith between a retracted position and an extended position, a pivot tip member between a first working position and a second working position, said pivot tip member being in axial alignment with said work piece shaft in said first working position, the axis of said pivot tip member being substantially normal to the longitudinal axis of said work piece shaft in said second working position, first holding means to hold said work piece shaft in said extended position, and second holding means to hold said pivot tip member in said first working position in axial alignment with said work piece shaft, wherein said pivot tip member includes a socket member, an axial bore through said socket member, said axial bore being axially aligned with said work piece shaft in said first working position, a tool received in said axial bore of said socket member and extending through said bore for end-to-end abutting contact with said work piece shaft when in said first working position.

2. A pivot tip tool, comprising a hand grasp member, an elongated member aligned with said hand grasp member, a work piece shaft mounted in relation to said elongated member for relative movement therewith between a retracted position and an extended position, a pivot tip member pivotable between a first working position and a second working position, said pivot tip member being in axial alignment with said work piece shaft in said first working position, the axis of said pivot tip member being substantially normal to the longitudinal axis of said work piece shaft in said second working position, first holding means to hold said work piece shaft in said extended position, and second holding means to hold said pivot tip member in said first working position in axial alignment with said work piece shaft, wherein said pivot tip member includes a socket member, an axial bore through said socket member, said axial bore being axially aligned with said work piece shaft in said first working position, the axis of said bore being substantially normal to the longitudinal axis of said work piece shaft in said second working position, a tool received in said axial bore of said socket member and extending through said bore for abutting contact of its end with a side wall portion of said work piece shaft when in said second working position.

* * * * *